US005429099A

United States Patent [19]

DeLand

[11] Patent Number: 5,429,099

[45] Date of Patent: Jul. 4, 1995

[54] ANTI-PERMEATION FILTER FOR VAPOR MANAGEMENT VALVE

[75] Inventor: Daniel L. DeLand, Davison, Mich.

[73] Assignee: Lectron Products, Inc., Rochester Hills, Mich.

[21] Appl. No.: 303,234

[22] Filed: Sep. 8, 1994

[51] Int. Cl.[6] ..... F02M 33/02

[52] U.S. Cl. ..... 123/520; 123/516; 251/129.21; 251/34

[58] Field of Search ..... 123/520, 519, 518, 516, 123/198 D, 521; 251/34, 129.21

[56] References Cited

U.S. PATENT DOCUMENTS

| | | | |
|---|---|---|---|
| 4,534,375 | 8/1985 | Fox . | |
| 4,567,910 | 2/1986 | Slavin et al. . | |
| 4,741,317 | 5/1988 | Vost | 123/519 |
| 4,875,499 | 10/1989 | Fox | 251/129.21 |
| 4,951,637 | 8/1990 | Cook | 123/520 |
| 5,050,568 | 9/1991 | Cook | 123/521 |
| 5,065,979 | 11/1991 | Detweiler et al. . | |
| 5,083,546 | 1/1992 | Detweiler | 123/520 |
| 5,115,785 | 5/1992 | Cook | 123/520 |
| 5,156,178 | 10/1992 | Harris | 123/516 |
| 5,183,022 | 2/1993 | Cook | 123/520 |
| 5,253,629 | 10/1993 | Fornuto | 123/519 |
| 5,277,167 | 1/1994 | DeLand et al. | 123/520 |
| 5,358,215 | 10/1994 | Buth | 251/129.21 |

*Primary Examiner*—Carl S. Miller

*Attorney, Agent, or Firm*—Harness, Dickey & Pierce

[57] ABSTRACT

A flow regulator for automotive vehicles of the type having a computer-controlled emission control system. The flow regulator has an electric vacuum regulator (EVR) valve that regulates the vacuum signal provided to a vacuum regulator valve in accordance with the current signal supplied to the EVR valve by the engine controller unit. The vacuum regulator valve includes a control chamber and a valve chamber that are separated by a movable diaphragm valve assembly. The preload on a biasing spring acting on the diaphragm valve assembly can be adjusted during calibration of the flow regulator for setting a first calibration point. An adjustable flow restrictor provided in the inlet portion of the vacuum regulator valve can be varied during calibration for setting a second calibration point. In addition, an anti-permeation filter is provided for inhibiting the venting of fuel vapors to atmosphere that have permeated through the diaphragm valve. In operation, the flow regulator is operable to generate substantially linear output flow characteristic between the two calibration points as a function of the current signal in a manner that is independent of changes in manifold vacuum.

12 Claims, 2 Drawing Sheets

ANTI-PERMEATION FILTER FOR VAPOR MANAGEMENT VALVE

BACKGROUND OF THE INVENTION

The present invention relates generally to electronically-controlled flow regulators of the type used in automotive vehicles equipped with computer-controlled emission control systems.

As is known, virtually all modern automotive vehicles are equipped with emission control systems that are operable for limiting the emission of hydrocarbons into the atmosphere. Such emission control systems typically include an evaporative emission control system which traps fuel vapors from the fuel tank in a carbon filled canister and a purge system which draws the vapors from the canister into the engine intake system. In this manner, fuel vapors from the fuel tank are delivered into the engine for subsequent combustion.

Conventional evaporative emission control systems are equipped with electronically controlled purge valves for regulating the flow rate of fuel vapors introduced into the intake system in response to specific engine operating parameters. Conventional purge valves comprise pulse width modulation (PWM) solenoid valves which are responsive to a duty cycle control signal from the engine computer. However, PWM purge valves provide uneven flow characteristics, particularly at low engine speeds, and also do not provide consistent flow control independent of variations in manifold vacuum.

In view of increasingly stringent emission regulations, the demands on the evaporative emission control system have increased dramatically. In particular, in order to satisfy current EPA emission requirements, the flow capability of the evaporative emission system must be increased. To achieve this result within the EPA city test cycle, it is therefore necessary to provide purge flow at engine idle speeds. Moreover, purge flow control must also be accurately regulated so as not to cause unacceptable excursions in overall engine output emissions.

To provide such enhanced flow control, it is desirable to have the output flow characteristics of the purge valve be proportional to the duty cycle of the electronic control signal applied to the valve, even at low engine speeds, and yet be independent of variations in the manifold vacuum. Accordingly, the output flow of the valve should be substantially constant at a given duty cycle control signal and be controllable in response to regulated changes in the duty cycle regardless of variations in manifold vacuum. Moreover, it is also desirable that the output flow of the valve vary substantially linearly from a predetermined "minimum" flow rate at a "start-to-open" duty cycle to a specified "maximum" flow rate at 100% duty cycle.

The above performance demands have prompted the recent development of a purge flow regulator that combines an electric vacuum regulator (EVR) solenoid valve with a diaphragm-type vacuum regulator valve to provide the desired continuous controlled flow characteristics independent of variations in manifold vacuum. In particular, the EVR solenoid valve is connected to the diaphragm vacuum regulator valve so as to regulate the vacuum signal supplied to the reference side of the diaphragm valve in accordance with the control signal from the engine computer. A closure member, associated with the opposite side of the diaphragm, controls flow from the input port to the output port of the vacuum regulator valve in response to regulated movement of the diaphragm. Since the EVR valve is in communication with atmosphere and a vacuum source, such as the intake manifold of the engine, the amount of vacuum (i.e., the vacuum signal) provided to the reference side of the diaphragm is proportional to the electric control signal supplied to the EVR valve by the on-board engine control computer. Thus, output flow through the vacuum regulator valve is controlled by the duty cycle of the control signal applied to the EVR valve.

Examples of electronically controlled flow purge regulators of this type are disclosed in U.S. Pat. No. 4,534,378 to Cook and U.S. Pat. No. 5,050,568 to Fox. However, for such conventional flow regulators to satisfy the above-described performance specifications, the purge flow regulator must be precisely calibrated. It has been proposed to calibrate the purge flow regulator by adjusting the characteristics of the EVR solenoid valve, In particular, the preload on the armature bias spring of the EVR valve is adjusted for setting the minimum flow rate at the "start-to-open" duty cycle. Such changes in the magnitude of preload on the armature bias spring effectively displaces the performance curve without changing its slope. In addition, the reluctance of the solenoid flux path is adjusted for setting the maximum flow rate at the 100% duty cycle. However, changes in reluctance result in a corresponding change in the slope of the performance curve. As can be appreciated, this calibration approach is problematic in that each adjustment affects the other, such that the two calibration adjustments are dependent and cumulative in nature. As such, it typically requires several iterations to "zero-in" on both of the desired calibration points. Accordingly, while such conventional flow regulators are generally successful in automotive emission control systems for their intended purpose, there is a continuing need to develop alternatives which meet the above-noted performance specifications and can be manufactured and calibrated in a more efficient and cost effective manner.

In view of the above, an improved vapor management valve was developed which combines an EVR valve and a vacuum regulator valve for generating an output flow characteristic that is proportional to the duty cycle of the electrical control signal and yet is independent of variations in manifold vacuum, this vapor management valve being disclosed in commonly-owned U.S. Pat. No. 5,277,167 issued to DeLand et al. Upon continued development of this commercially-successful vapor management valve, it was discovered that fuel vapor can permeate through the flexible diaphragm membrane, particularly when the system is inactive. Accordingly, in an effort to provide further gains in emission control, an anti-permeation filter has been developed with adsorptive properties which prevents the fuel vapors from being vented to the atmosphere. During normal operation of the vapor management valve, the adsorbed vapors are extracted from the anti-permeation filter by the inlet air flow and are delivered to the engine for subsequent combustion.

SUMMARY OF THE INVENTION

Accordingly, it is the primary object of the present invention to provide a modified version of the vapor management valve disclosed in commonly owned U.S. Pat. No. 5,277, 167 which has means for controlling the vapors which may otherwise permeate the diaphragm and be vented to the atmosphere. Particularly, the present invention provides a means of adsorbing fuel vapors which permeate the diaphragm and later, during normal operation, releasing the adsorbed vapors into the flow of air passing into the intake manifold.

Additional objects and advantages of the present invention will become apparent from a reading of the following detailed description of the preferred embodiment taken in conjunction with the accompanying drawings and appended claims.

DESCRIPTION OF THE PREFERRED EMBODIMENT

Figure 1:
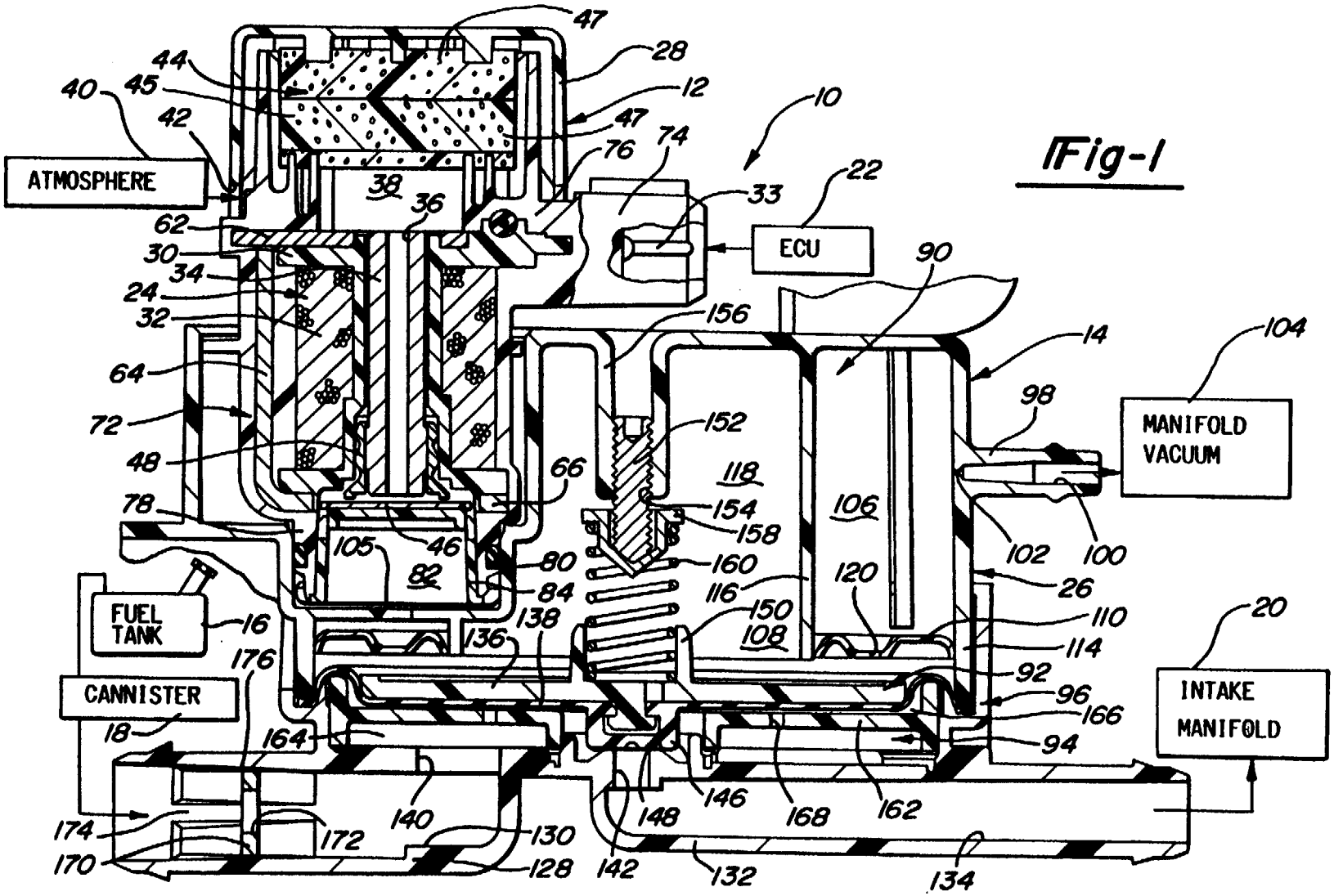
FIG. 1 is a sectional view of an electronically-controlled flow regulator shown diagrammatically associated with an evaporative emissions control system and equipped with an anti-permeation filter according to a first preferred embodiment of the present invention.

In general, the present invention is directed to a modified construction for the vapor management valve disclosed in commonly owned U.S. Pat. No. 5,277,167 to DeLand et al., the disclosure of which is herein incorporated by reference. However, to provide a basic understanding of the structure of the vapor management valve as it relates to the present invention, the following structural overview is provided. Thus, a preferred embodiment of an electronically-controlled flow regulator is disclosed which is adapted for use in an evaporative emission control system for purging fuel vapors collected in a charcoal canister into the intake system of the vehicle's internal combustion engine. However, it will be readily apparent that the improved flow regulator has utility in other vehicular flow controlling applications.

In the drawings, wherein for purposes of illustration is shown a preferred embodiment of a vapor management valve incorporating the present invention, electronically controlled flow regulator 10 is disclosed as having an electronically-actuated vacuum regulator ("EVR") valve 12 and a vacuum regulator valve 14. By way of example, flow regulator 10 is shown as a vapor management valve of the type associated with a conventional evaporative emission control system for an automotive vehicle. More specifically, fuel vapors vented from a fuel tank 16 are collected in a charcoal canister 18 and are controllably purged by vapor management valve 10 into the intake system 20 (i.e., the intake manifold) of the vehicle's internal combustion engine in response to electrical control signals supplied to EVR valve 12 by a remote engine controller unit ("ECU") 22. While EVR valve 12 and vacuum regulator 14 are shown assembled as a unitary flow regulator 10, it is to be understood that the valves could be separate components that are interconnected by suitable tube connections in a known manner.

As seen in FIG. 1, EVR valve 12 is an encapsulated solenoid assembly 24 secured to an upper valve housing 26 of vacuum regulator valve 14 having a filter cover 28 removably connected to a top portion thereof. Solenoid assembly 24 includes a bobbin 30, fabricated from a non-magnetic nylon-tape material, having a plurality of coil windings 32 wound thereon. The ends of coil winding 32 are electrically connected to a pair of terminal blades 33. A magnetic pole piece 34 extends through a hollow central core of bobbin 30 and, in turn, has a central bore 36 formed therein which serves as an air passageway which communicates with an air inlet 38. Atmospheric air, identified by block 40, is admitted into air inlet 38 through a plurality of apertures 42 formed in filter cover 28 and is filtered by an anti-permeation filter assembly 44 located inside filter cover 28. The anti-permeation filter assembly 44 contains a layer of a suitable adsorptive material 45 such as, for example, activated charcoal that is sandwashed between two layers 47 of a different porous filtering material. The discharge of atmospheric air from the bottom of central bore 36 in pole piece 34 is controlled by a flat disk-type magnetic armature 46 which is adapted to seat against a non-magnetic valve seat member 48 that is fixed to a lower end of pole piece 34. The valve seat member 48 has a central bore 50 formed therein having a diameter substantially equal to the outside diameter of pole piece 34. The lower portion of valve seat member 48 has a radially enlarged annular flange 52 which accommodates a shallow counterforce 54 formed in a bottom face 56 of valve seat member 48. The resulting annular-shaped bottom face 56 defines a valve seat and is preferably machined with a slight radial back taper to provide a circular "line" seal with flat disk armature 46.

During assembly, valve seat member 48 is installed on the lower end of pole piece 34 in a fixture that automatically sets the axial position of valve seat surface 56 relative to an end face 58 of pole piece 34. More specifically, when pole piece 34 is inserted into bore 50, a slightly oversized knurled region 60 of pole piece 34 embeds in the inner wall of valve seat bore 50 to create a tight frictional engagement between the two components. This is important since the axial distance between end face 58 of pole piece 34 and seat surface 56 of valve seat member 48 defines the primary or working air gap between pole piece 34 and armature 46 in the "closed" valve position when EVR valve 12 is fully assembled.

Surrounding the top end of pole piece 34 is an annular-shaped magnetic flux collector ring 62 that is connected to a magnetic L-frame member 64. L-frame member 64 includes an annular-shaped lower segment 66 that surrounds armature 46. Thus, when solenoid assembly 24 is energized by current flow through coil winding 32, the magnetic flux path is defined by pole piece 34, armature 46, L-frame member 64, and flux collector ring 62. The combined pole piece 34 in valve seat member 48 sub-assembly is shown inserted into an enlarged bore section 68 of bobbin 30 until the top end of pole piece 34 is substantially flush with the top surface of flux collector ring 62. A frictionally bond valve seat member 48 within bore section 68 of bobbin 30, ridge-like bars 70 formed on the outer wall surface of valve member 48 embed on or "bite" into the inner wall surface of bore 68 to resist withdrawal therefrom. In addition, the tight seal formed between bobbin 30 and valve seat member 48 serves to inhibit leakage of atmospheric air from air inlet 38 around the outside of seat member 48.

Flux collector ring 62 is installed on the top of bobbin 30 and L-frame member 64 is installed with lower segment 66 thereof place over the bottom of bobbin 30. L-frame member 64 has a pair of depending tabs (not shown) which are adapted to mate with corresponding recesses formed on opposite sides of flux collector ring 62, for mechanically joining the two components. With the magnetic segments joined to wound bobbin 30, the entire sub-assembly is encapsulated in an injection mode which forms a housing 72 for solenoid assembly 24. The injection molding process completely encloses and seals solenoid assembly 24 while simultaneously forming a plug-in receptacle 74 enclosing terminal blades, a mounting flange 76 for filter cover 28, and a lower connecting flange 78 for mating with upper valve housing 26.

The lower connecting flange 78 of housing 72 for solenoid assembly 24 is shown retained and sealed within external cavity 80 formed in upper valve housing 26. Moreover, the circular-shaped cavity defined by the inner diameter of lower connecting flange 78 of solenoid housing 72 defines an EVR chamber 82 below armature 46 that selectively communicates with air inlet 38 via central bore 36. A non-magnetic cup shaped member 84 is disposed within EVR chamber 82 for supporting armature 46 in an "open" valve position (FIG. 1) displaced from valve seat member 48. The inside diameter of EVR chamber 82 is slightly greater than the diameter of armature 46 to permit axial movement yet confine lateral movement of armature 46 therein. To facilitate air flow around the periphery of armature 46 when it is displaced from sealed engagement (i.e., the "closed" valve position) with valve seat member 48, armature 46 has a plurality of radially-spaced notches 86, formed along its peripheral edge, and cup member 84 has a plurality of slots 88 formed therein for providing a communication pathway between pole piece central bore 36 and EVR chamber 82.

With continued reference to FIG. 1, vacuum regulator valve 14 is shown as a vacuum-operable diaphragm valve having a control chamber 90 formed within upper housing 26 and above a movable diaphragm valve assembly 92, and a valve chamber 94 formed within a lower housing 86 below diaphragm valve assembly 92. In addition, a vacuum inlet, shown as nippled connector 98, is formed in upper housing 26 and has a passage 100 which communicates with control chamber 90 through a flow-restrictive orifice 102. Nippled connector 98 is adapted for connection via suitable tubing (not shown) to a vacuum signal source, namely manifold vacuum for the intake manifold of the engine, identified by block 104. Moreover, control chamber 90 communicates with EVR chamber 82 via an orifice 105 formed in the bottom of external cavity 80 such that the vacuum signal (negative pressure) delivered to control chamber 90 from EVR valve 12 is a controlled portion of the vacuum input at connector 98 as determined by the electrical control signal supplied by ECU 22 to windings 32 of solenoid assembly 24. Alternatively, it is contemplated that the vacuum inlet could be positioned to communicate directly with EVR chamber 82.

Control chamber 90 is divided into two distinct portions, namely an attenuation or "damping" chamber 106 and a reference chamber 108 by a damping ring 110. In general, damping chamber 106 is located intermediate to EVR chamber 82 and reference chamber 108 and is operable for attenuating fluctuations in the vacuum signal supplied to reference chamber 108 and diaphragm valve assembly 92 upon actuation of EVR valve 12. More particularly, damping ring 110 is an annular member which is retained between an outer wall portion 114 and an inner wall portion 116 of upper housing 26 for segregating damping chamber 106 from reference chamber 108. Damping chamber 106 is located above damping ring 110 while reference chamber 108 is located below damping ring 110 and includes a central cavity 118 defined by circular inner wall portion 116 so as to act over the entire top surface of diaphragm valve assembly 92. One or more damping orifices 120 are formed in damping ring 110 to attenuate fluctuations in the vacuum signal supplied to vacuum regulator valve 14 upon actuation of EVR valve 12 which, in turn, inhibits undesirable oscillation (i.e., "flutter") of diaphragm valve assembly 92. More specifically, since ECU 22 supplies a sawtooth waveform, preferably at about 100 Hz, to drive solenoid assembly 24 of EVR valve 12, direct application of the vacuum signal in EVR chamber 82 to diaphragm valve assembly 92 in control chamber 90 may cause diaphragm valve assembly 92 to oscillate. Thus, it is desirable to isolate diaphragm valve assembly 92 from the 100 Hz vacuum fluctuation by providing damping chamber 106 with a larger volume than EVR chamber 82 for effectively reducing the magnitude of any pressure fluctuations. In addition, damping orifice 120 is sized to provide the amount of restrictive flow necessary to balance the vacuum pressure between damping chamber 106 and reference chamber 108 such that a balanced vacuum is established in control chamber 90 that matches the vacuum signal in EVR chamber 82.

To provide means for regulating the purge flow of fuel vapors from canister 18 in the engine's intake system 20, lower housing 96 of vacuum regulator valve 14 includes a nippled inlet connector 128 adapted for connecting inlet passageway 130 to canister 18 via suitable tubing (not shown) and a nippled outlet connector 132 adapted for connecting outlet passageway 134 to intake manifold 20 of the engine. Vacuum-actuated diaphragm valve assembly 92 is comprised of a rigid piston 136 and a flexible diaphragm 138 that are retained between valve housings 26 and 96 for controlled axial movement to regulate the purged flow from canister 18 and inlet passageway 130 to outlet passageway 134 in the engine's intake manifold 20. In addition, inlet passageway 130 communicates with valve chamber 94 via inlet orifice 140. Valve chamber 94 is adapted to selectively communicate with outlet passageway 134 via an exit tube 142 in response to the axial movement of a poppet-type closure member 146 in a direction away from an annular valve seat 148 formed at one end of exit tube 142.

Poppet-type closure member 146 is integrally associated with an underside portion of diaphragm valve assembly 92, while the upper side of diaphragm valve assembly 92 includes a first spring retainer 150 which is preferably integral with piston 136. A calibration screw 152 is threaded into a threaded aperture 154 formed in a central boss 156 of upper valve housing 26 and which supports a second spring retainer 158 thereon. A helical coil spring 160 is centrally disposed within reference chamber 108 of control chamber 90 and is retained between the aligned spring retainers 150 and 158 for, exerting a biasing force on diaphragm valve assembly 92 such that poppet-type closure member 146 is normally biased against valve seat 148 for inhibiting flow through vacuum regulator valve 14.

When the engine of a vehicle equipped with vapor management valve 10 is not in operation, EVR valve 12 is not energized (i.e., 0% duty cycle) such that armature 46 is urged by gravity and atmospheric air to the "open" valve position displaced from seated engagement with valve seat member 48 for engagement with an upper planar surface of cup member 84. Moreover, in the absence of manifold vacuum 104 being applied to control chamber 90 via passage 100 and flow-restrictive orifice 102, the preload of coil spring 160 urges diaphragm valve assembly 92 downward to cause closure member 146 to seat against valve seat 148. In this condition, flow of fuel vapors from valve chamber 94 to outlet port 142 is inhibited. However, when the vehicle is in operation, a vacuum pressure is introduced into control chamber 90 through vacuum inlet passage 100 and flow-restrictive orifice 102, thereby tending to maintain armature 46 in the "open" valve position. Concurrently, air flow from the atmosphere 40 is drawn through the plurality of apertures 42 formed in filter cover 28, and through anti-permeation filter assembly 44 and particularly through the layer of adsorptive material 45, and passes into air inlet 38. The air flow then enters EVR chamber 82 for generating a control vacuum signal within control chamber 90 which is a controlled portion of the manifold vacuum 104 supplied at inlet passage 100. As is known, energization of solenoid assembly 24 of EVR valve 12 in response to the control signal supplied by engine control unit ("ECU") 22 is operable for exerting a magnetic attractive force between armature 46 and pole piece 34 in opposition to the effect of the vacuum pressure from manifold vacuum 104. Thus, the amount of vacuum, and hence the "vacuum signal" provided to control chamber 90 of vacuum regulator valve 14 is controlled by the degree to which armature 46 is attracted toward valve seat 48. In particular, the magnitude of the magnetic attractive force exerted on armature 46 is equal to the product of the vacuum pressure in EVR chamber 82 multiplied by the cross-sectional area of armature 46. In addition, the flow restriction from air inlet 38 to EVR chamber 82 results in a pressure drop proportional to the magnetic force applied to armature 46. Therefore, as the magnetic attraction exerted on armature 46 increases, the level of vacuum pressure in EVR chamber 82 also increases. Similarly, as the magnetic attraction force exerted on armature 46 decreases, the level of vacuum pressure in EVR chamber 82 also decreases. Thus, the percentage duty cycle of the electrical control signal supplied to EVR valve 12 from ECU 22 controls the "vacuum signal" provided to the reference side of vacuum regulator valve 14.

Vacuum regulator valve 14 is shown to include a defuser ring 162 which segregates valve chamber 94 into a lower prechamber 164 communicating with inlet passageway 130 via inlet orifice 140, and an upper chamber 166 which is located above defuser ring 162 and which communicates with exit tube 142. In addition, defuser ring 162 has a series of equally-space radial orifices 168 for permitting communication between prechamber 164 and upper chamber 166.

As vapors from canister 18 travel through the inlet passageway 130 and enter valve chamber 94 via inlet orifice 140, the vapor concentration within valve chamber 94 is greater than the concentration in control chamber 90. This difference in concentration creates a condition in which the vapors permeate diaphragm membrane 138 and pass into control chamber 90. Once the vapors are within control chamber 90, they are free to communicate with air inlet 38 since, as previously stated, armature 46 is not seated against valve seat member 48 and the vapors may travel through center bore 36 into air inlet 38 and, thus attempt to migrate through anti-permeation filter assembly 44. However, the intermolecular attractive forces of adsorptive material 45, located within anti-permeation filter assembly 44, cause the vapors to absorb (or condense) on its surface. This adsorption prevents the vapors from being emitted into atmosphere 40 via the plurality of apertures 42 formed in filter cover 28.

The adsorbed vapors are released from adsorptive material 45 when the engine of the vehicle equipped with vapor management valve 10 is put in an operating condition. As manifold vacuum 104 lowers the pressure in control chamber 90, the combination of decreased pressure and air flowing across adsorptive material 45 from atmosphere 40, the intermolecular attractive forces are overcome and the fuel vapors are drawn into air inlet 38. From air inlet 38 the fuel vapors are drawn through center bore 36, past the plurality of radially-spaced notches in armature 46 and into EVR chamber 82. Once in EVR chamber 82, the fuel vapors travel through orifices 105 and 120 into control chamber 90. From control chamber 90 the fuel vapors are drawn through restrictive orifice 102 into passage 100 provided in nipple connection 98. Finally, the fuel vapors in nipple connection 98 are drawn into the manifold via suitable tubing (not shown), for subsequent combustion.

Figure 2:
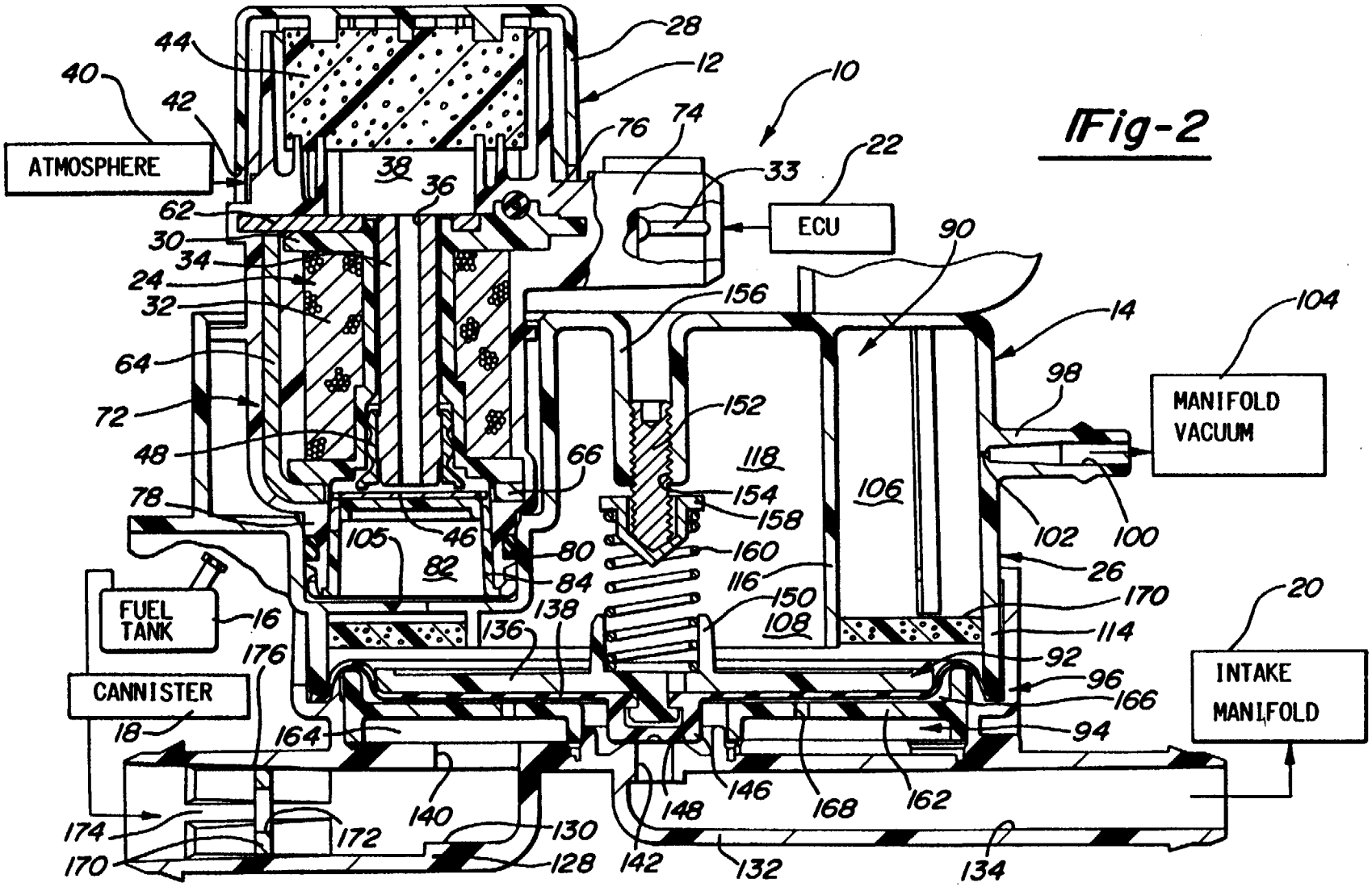
FIG. 2 is a view similar to FIG. 1, showing an alternative location for the anti-permeation filter of the present invention.

In accordance with an alternative preferred embodiment shown in FIG. 2, the layer of adsorptive material is shown in the form of an annular filter ring 170 that has replaced damping ring 110 of FIG. 1. More particularly, adsorptive filter ring 170 is retained between outer wall portion 114 and inner wall portion 116 of upper housing 26 for segregating damping chamber 106 from reference chamber 108. In operation, annular adsorptive filter ring 170 attenuates fluctuations in the vacuum signal supplied by vacuum regulator valve 14 upon actuation of EVR valve 12 to inhibit oscillation of diaphragm valve assembly 92. It will be appreciated that vapor management valve 10 of the present invention could also be equipped with adsorptive filter ring 170 in combination with filter assembly 44 if a particular application warrants such use.

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. A flow regulator for controlling the purging of fuel vapors collected in a canister of an evaporative emission control system into an intake system of an internal combustion engine, said flow regulator comprising:

a first valve having a vacuum inlet in communication with a vacuum source of the intake system and means for generating a vacuum signal that is a percentage of the vacuum received at said vacuum inlet in response to an electrical control signal;

a second valve having a first chamber in communication with said vacuum signal, a second chamber, a diaphragm valve retained for movement between said first and second chambers, inlet means connecting the canister for communication with said second chamber, outlet means communicating with the engine intake system, closure means for controlling flow between said inlet means and said outlet means in response to movement of said diaphragm valve, biasing means acting on said diaphragm valve for inhibiting flow between said inlet means and said outlet means, first calibration means for varying the biasing force exerted by said biasing means on said diaphragm valve for setting a first flow rate limit, and second calibration means for varying the flow in said inlet means to set a second flow rate limit, said flow regulator operable to generate substantially linear flow between said first and second flow rate limits as a function of the value of said control signal and independent of variations in the magnitude of the vacuum supplied to said vacuum inlet by said vacuum source; and a filter capable of capturing fuel vapors which have permeated through said diaphragm valve and which is further capable of releasing the captured vapors during normal operation of said flow regulator and allowing the released vapors to be drawn into the intake system of the internal combustion engine for subsequent combustion.

2. The flow regulator of claim 1 wherein said first valve is an electric vacuum regulator valve and said means for generating said vacuum signal includes an electromagnetic solenoid assembly having a passageway communicating with atmosphere, an EVR chamber communicating with said vacuum inlet, a magnetic flux path including a magnetic armature member, and means for establishing the flow of electromagnetic flux through said flux path, said magnetic armature being movable for controlling flow through said passageway in response to the magnitude of said electric control signal supplied to said means for establishing flow of electromagnetic flux, and said filter is located between said passageway and atmosphere.

3. The flow regulator of claim 2 wherein said filter includes a layer of adsorptive material for preventing fuel vapors in said passageway from being vented to atmosphere.

4. The flow regulator of claim 1 wherein said filter is an annular filter ring made of an adsorptive material, said filter ring being retained between said first and second chambers for absorbing fuel vapors permeating through said diaphragm valve.

5. A flow regulator for controlling the purging of fuel vapors collected in a canister of an evaporative emission control system into an intake system of an internal combustion engine, comprising:

a first valve having a vacuum inlet connected to a vacuum source, a first chamber in communication with said vacuum inlet, a second chamber, a pressure-operable diaphragm valve retained for movement between said first and second chambers, inlet means connecting the canister for communication with said second chamber, outlet means communicating with the engine intake system such that movement of said diaphragm valve is operable for controlling flow between said inlet means and said outlet means, biasing means acting on said diaphragm valve for biasing said diaphragm valve to inhibit flow between said inlet means and said outlet means, first calibration means for varying the biasing force exerted by said biasing means on said diaphragm valve for setting a first flow rate value, and second calibration means for varying the flow in said inlet means to set a second flow rate value;

a second valve in communication with said first chamber of said first valve and having electrically-controllable means for generating a vacuum signal as a percentage of the vacuum pressure received at said vacuum inlet in response to an electrical control signal, said vacuum signal being controllably regulated for generating substantially linear flow between said first and second flow rate values as a function of the magnitude of said electrical control signal and independent of variations in said vacuum pressure supplied to said vacuum inlet by said vacuum source; and a filter capable of capturing fuel vapors which have permeated said diaphragm valve and which is further capable of releasing the captured vapors during normal operation of said flow regulator and allowing the released vapors to be drawn into the intake system of the internal combustion engine for subsequent combustion.

6. The flow regulator of claim 5 wherein said first valve is an electric vacuum regulator valve and said means for generating said vacuum signal includes an electromagnetic solenoid assembly having a passageway communicating with atmosphere, an EVR chamber communicating with said vacuum inlet, a magnetic flux path including a magnetic armature member, and means for establishing the flow of electromagnetic flux through said flux path, said magnetic armature being movable for controlling flow through said passageway in response to the magnitude of said electric control signal supplied to said means for establishing flow of electromagnetic flux, and said filter is located between said passageway and atmosphere.

7. The flow regulator of claim 6 wherein said filter includes a layer of adsorptive material for preventing fuel vapors in said passageway from being vented to atmosphere.

8. The flow regulator of claim 5 wherein said filter is an annular filter ring made of an adsorptive material, said filter ring being retained between said first and second chambers for absorbing fuel vapors permeating through said diaphragm valve.

9. An evaporative emission control system for collecting fuel vapors vented from the vehicle's fuel tank and purging the fuel vapors into the intake system for combustion in the internal combustion engine, comprising:

a canister in communication with the fuel system for collecting the fuel vapors therein; and a vapor management valve for controlling the purging of fuel vapors from said canister into the intake system in response to an electrical control signal, said vapor management valve including a vacuum regulator having a vacuum inlet connected to engine manifold vacuum, a first chamber in communication with said vacuum inlet, a second chamber, a pressure-operable diaphragm valve retained for movement between said first and second chambers, inlet means connecting said canister for communication with said second chamber, outlet means communicating with the intake system such that movement of said diaphragm valve is operable for controlling flow between said inlet means and said outlet means, biasing means acting on said diaphragm valve for biasing said diaphragm valve to inhibit flow between said inlet means and said outlet means, first calibration means for varying the biasing force exerted by said biasing means on said diaphragm valve for setting a first flow rate value, and second calibration means for varying the flow in said inlet means to set a second flow rate value, said vapor management valve further including an electric vacuum regulator in communication with said first chamber of said first valve and having electrically-controllable means for generating a vacuum signal as a percentage of engine manifold vacuum received at said vacuum inlet in response to said electrical control signal, said vacuum signal being controllably regulated for generating substantially linear flow between said first and second flow rate values as a function of the magnitude of said electrical control signal and independent of variations in engine manifold vacuum, and a filter capable of capturing vapors which have permeated the diaphragm membrane and which is further capable of releasing the captured vapors during normal operation of the flow regulator and allowing the released vapors to be drawn into the intake system of the internal combustion engine for subsequent combustion.

10. The control system of claim 9 wherein said electrically-controllable means includes an electromagnetic solenoid assembly having a passageway communicating with atmosphere, an EVR chamber communicating with said first chamber, a magnetic flux path including a magnetic armature member, and means for establishing the flow of electromagnetic flux through said flux path, said magnetic armature being movable for controlling flow through said passageway in response to the magnitude of said electric control signal supplied to said means for establishing flow of electromagnetic flux, and said filter is located between said passageway and atmosphere.

11. The flow regulator of claim 2 wherein said filter includes a layer of adsorptive material for preventing fuel vapors in said passageway from being vented to atmosphere.

12. The flow regulator of claim 1 wherein said filter is an annular filter ring made of an adsorptive material, said filter ring being retained between said first and second chambers for absorbing fuel vapors permeating through said diaphragm valve.

* * * * *